US005562881A

United States Patent [19]

Berghoff

[11] Patent Number: 5,562,881

[45] Date of Patent: Oct. 8, 1996

[54] SPECIAL-STEEL ALLOY CHAINS AND CHAIN PARTS

[75] Inventor: Jürgen Berghoff, Schwerte, Germany

[73] Assignee: J.D. Theile GmbH & Co., KG, Schwerte, Germany

[21] Appl. No.: 464,794

[22] PCT Filed: Oct. 15, 1994

[86] PCT No.: PCT/EP94/03401

§ 371 Date: Jun. 26, 1995

§ 102(e) Date: Jun. 26, 1995

[87] PCT Pub. No.: WO95/12692

PCT Pub. Date: May 11, 1995

[30] Foreign Application Priority Data

Oct. 30, 1993 [DE] Germany ..... 43 37 148.5

[51] Int. Cl.[6] ..... C22C 38/44

[52] U.S. Cl. ..... 420/108; 148/335

[58] Field of Search ..... 148/335; 420/108

[56] References Cited

FOREIGN PATENT DOCUMENTS 61-270355 11/1986 Japan .

*Primary Examiner*—Deborah Yee
*Attorney, Agent, or Firm*—Charles E. Baxley, Esq.

[57] ABSTRACT

Special-steel alloys for high-load-bearing chains and corresponding chain parts containing portions of carbon, silicon, manganese, phosphorus, sulfur, chromium, molybdenum, nickel and aluminum. In order to impart a higher strength and toughness for this purpose to the special-steel an additional alloy proportion of tungsten is used in a given weight ratio.

1 Claim, No Drawings

SPECIAL-STEEL ALLOY CHAINS AND CHAIN PARTS

TECHNICAL FIELD

The present invention relates to the use of a special-steel alloy containing proportions of carbon, silicon, manganese, phosphorus, sulfur, chromium, molybdenum, nickel, aluminum and iron, the balance consisting of impurities resulting from manufacture, in accordance with the features of the Claim, as material for the manufacture of chains and chain parts.

THE PRIOR ART

Such an alloy is known, in principle, from U.S. Pat. No. 4,729,872. This does not apply, to be sure, with respect to the use of such an alloy for chains or chain parts.

A conventional material for chains and chain parts has the following chemical composition with respect to the essential secondary components:

| C | Si | Mn | P | S | Cr |
|---|---|---|---|---|---|
| 0.20–0.26% | <0.25% | 1.10–1.40% | <0.020% | <0.020% | 0.40–0.60% |
| **Mo** | **Ni** | **Al** | **Cu** | **N** | |
| 0.50–0.60% | 0.90–1.10% | 0.020–0.050% | <0.25% | <0.012% | |

In order to optimize this known material, the tolerance limits for the alloy percentages have in part been narrowed and in part widened but the composition has been left essentially unchanged because in addition to the strength, the necessary heat treatment of the special-steels upon the manufacture of chains and chain parts must also be taken into account, since, in particular, flash welding and resistance welding must be used in the manufacture of chain links. Here, it is important that the necessary technological properties of the material be retained also in the welded region-of the chain links. Furthermore, upon the heat treatment of the finished chain, a compromise must be found between the hardness, and therefore the strength of the material, and the resistance of wear, in order to take into account the toughness properties which are generally reduced with a higher strength.

In order to meet the increasing demands on round-steel chains and accessories for mining, namely so-called mining chains, longer lives have been obtained by changes in the geometry of the chain links and the chain parts. However, in this connection, one rapidly encounters the geometrical limit conditions which are established by the cases of use. In the case of conveyor chains with larger dimension, larger sprocket wheels are necessary, which require a corresponding structural height. Particularly in underground operation, it is necessary, in the case of conveyor systems, to save on height of installation, for which purpose recourse has already been had, in the geometrical shaping of the chain links and chain parts, to different means such as flattening the chain links or providing different pitches of the vertically and horizontally extending chain links.

THE INVENTION

The present invention is based on the use of an improved alloy material for the chain parts and chain accessories. With the alloy used in accordance with the invention, higher strength and toughness of the special-steel provided for chains and chain accessories is obtained due to the additional alloying proportion of tungsten, without the forgeability, weldability and heat-treatment properties of the chain being impaired, as is an indispensable requirement for high-strength chains and chain parts, particularly mining chains and accessories.

The special-steel alloy for chains and chain accessories used in accordance with the invention makes it possible, with the same geometrical dimensions of the chain links or chain parts to obtain improved performance while, conversely, for the same performance, the amount of material used for chains and chain accessories can be reduced. Thus, a saving of energy and raw material is furthermore obtained as compared with the previously obtained increases in performance in the case of chains and chain parts.

I claim:

1. A chain link made from a steel alloy consisting by weight of the following:

from 0.19 to 0.26% C, <0.25% Si, from 0.95 to 1.40% mn, <0.015% P, <0.015% S, from 0.7 to 0.9% Cr, from 0.7 to 0.9% Mo, from 1.0 to 1.2% Ni, from 0.02 to 0.05% Al, and from 0.2 to 0.5% W for a total of 100%, the balance being iron with impurities resulting from manufacture.

* * * * *